US006939179B1

(12) United States Patent
Kieffer, Jr. et al.

(10) Patent No.: US 6,939,179 B1
(45) Date of Patent: Sep. 6, 2005

(54) MODULAR PLUG-IN ELECTRICAL WIRING SYSTEM

(76) Inventors: Don J. Kieffer, Jr., 2689 Samples Rd., Cumming, GA (US) 30041; Walter Williams, 2425 Cambridge Hills Rd., Cumming, GA (US) 30041

( * ) Notice: Subject to any disclaimer, the term of this patent is extended or adjusted under 35 U.S.C. 154(b) by 0 days.

(21) Appl. No.: 10/824,392

(22) Filed: Apr. 15, 2004

(51) Int. Cl.[7] ..... H01R 31/00
(52) U.S. Cl. ..... 439/650; 439/724
(58) Field of Search ..... 439/650, 724, 439/106, 107; 174/50, 53, 59, 60; 220/241, 220/242

(56) References Cited

U.S. PATENT DOCUMENTS 4,165,443 A * 8/1979 Figart et al. ..... 174/53
4,958,048 A * 9/1990 Bell ..... 174/53
6,146,191 A * 11/2000 Kerr et al. ..... 439/537
6,156,971 A 12/2000 May
6,514,652 B2 2/2003 Cash, Jr.
6,648,488 B1 * 11/2003 Pearce ..... 362/96

* cited by examiner

*Primary Examiner*—Renee Luebke
*Assistant Examiner*—James R. Harvey
(74) *Attorney, Agent, or Firm*—William B. Noll

(57) ABSTRACT

A modular plug-in electrical wiring system that includes a pair of intermatable modular units that avoids the presence of a tangled mass of bare wires and wire nuts associated with conventional receptacle systems. A first unit is secured within a wall recess, such as between a pair of building studs, while the second unit slidable engages the first unit and may be removable secured thereto. The system is versatile as it can be used for mounting electrical appliances to a wall/ceiling.

7 Claims, 6 Drawing Sheets

MODULAR PLUG-IN ELECTRICAL WIRING SYSTEM

FIELD OF THE INVENTION

This invention is directed to the field of hard wired electrical outlets, switches and the like, more particularly to a modular plug-in electrical wiring system for easy installation that avoids electrical outlet boxes having a tangled mass or exposed wires that can cause damage or injury.

BACKGROUND OF THE INVENTION

The present invention relates to a plug-in wiring system for use with residential and commercial construction, and for remodeling needs for hollow wall boxes. Typically, electrical wall outlets and switches can exhibit a tangled mess of electrical wires with plural exposed wires and bare terminals that can short and cause a fire, or even injury to people.

The prior art has sought to rectify certain of these problems by providing a safer system to install and use. Exemplary prior art is reflected in the following U.S. Patents:

a.) U.S. Pat. No. 6,156,971, to May, teaches an electrical system that includes modular components which quickly assemble to create common lighting and general utility electrical circuits. All wiring is completed in the electrical box prior to installing electrical devices such as switches and receptacles, thereby eliminating the need for extra length wires in electrical boxes and cumbersome wiring practices associated with conventional residential electrical circuits. The electrical devices plug into prewired electrical boxes, thereby providing quick and easy removal and replacement of the device in the event of failure. Common residential lighting and general utility circuits are automatically configured by simply selecting proper electrical components. A dedicated earth ground is automatically carried to each electrical component with no effort on the part of the installer, thereby providing safer electrical circuits. The electrical system provides multiconductor cables having cable sheathes extruded to a specific exterior profile to insure proper connection with electrical boxes thereby assuring proper configuration of electrical circuits. The electrical system also eliminates the need for wire nuts. However, the system thereof requires a plurality of boxes and adaptations for different applications.

b.) U.S. Pat. No. 6,514,652, to Cash, Jr., discloses a modular junction box receptacle having parallel high and low voltage circuitry portions separated by a barrier. A base housing of the receptacle receives a termination block that includes high and low voltage connections to respective high and low voltage portions of the base housing. A housing cover is installed over the base housing and termination block; the cover has an opening for passage thereinto of a face portion of the block. The receptacle accommodates a plug and play unit containing smart circuitry, the unit including high and low voltage circuitry connections for respective high and low voltage portions of the termination block. The unit can act as a variety of interchangeable devices in a smart system that incorporates pluralities of receptacles, including electrical outlets and simple electrical toggle switches, each containing low voltage connections. A plurality of such units may be incorporated in, for example, a household circuitry system. The units thereof requires the use of low voltage wiring or programmable sensors.

The prior art, as shown by the foregoing patents, teach complex solutions are complex in their operability and use, and do not offer the versatility that is capable of receiving a variety of devices, as found with the present invention. The simplicity and versatility of the system of this invention will become apparent in the description which follows, especially when read in conjunction with the accompanying drawings.

SUMMARY OF THE INVENTION

The present invention discloses a modular plug-in electrical wiring system for selective placement in a recess of a wall, such as to a conventional 2×4 building stud, where the system avoids certain of the pitfalls of traditional systems that have exposed bare wires and wire nuts. The system comprises a first electrical modular unit consisting of a housing formed by a pair of side walls, a bottom wall, and a top wall, where the respective walls combine to define an open face and recess for slidably receiving a second electrical modular unit. Additionally, the housing includes a rear wall, where the rear wall is characterized by a pair of spaced apart shoulder members having access means for receiving plural connectors along a first surface, and plural electrical access openings in electrical communication with the plural connectors along a second surface. Further, to secure the housing to the 2×4, external means are provided to fix the housing within the wall recess.

For sliding and mating engagement with the first electrical modular unit, a second electrical modular unit is provided. The second modular unit comprises a face plate with a U-shaped housing extending rearwardly therefrom, where the U-shaped housing is sized to be slidably received within the recess in the first electrical modular unit, and features a pair of legs having plural metal arms extending from the legs for electrical engagement with the electrical access openings. Finally, means are provided on the face plate for electrically activate the mated modular units.

Accordingly, a feature of this invention is a modular plug-in electrical wiring system that is constructed for ease of installation for a variety of electrical components.

Another feature of the invention is the provision of a pair of matable modular units that avoids the tangled mass of bare wires and wire nuts associated with conventional wall type receptacles.

These and other features hereof will become apparent from the following description and drawings.

DETAILED DESCRIPTION OF PREFERRED EMBODIMENT

Figure 1:
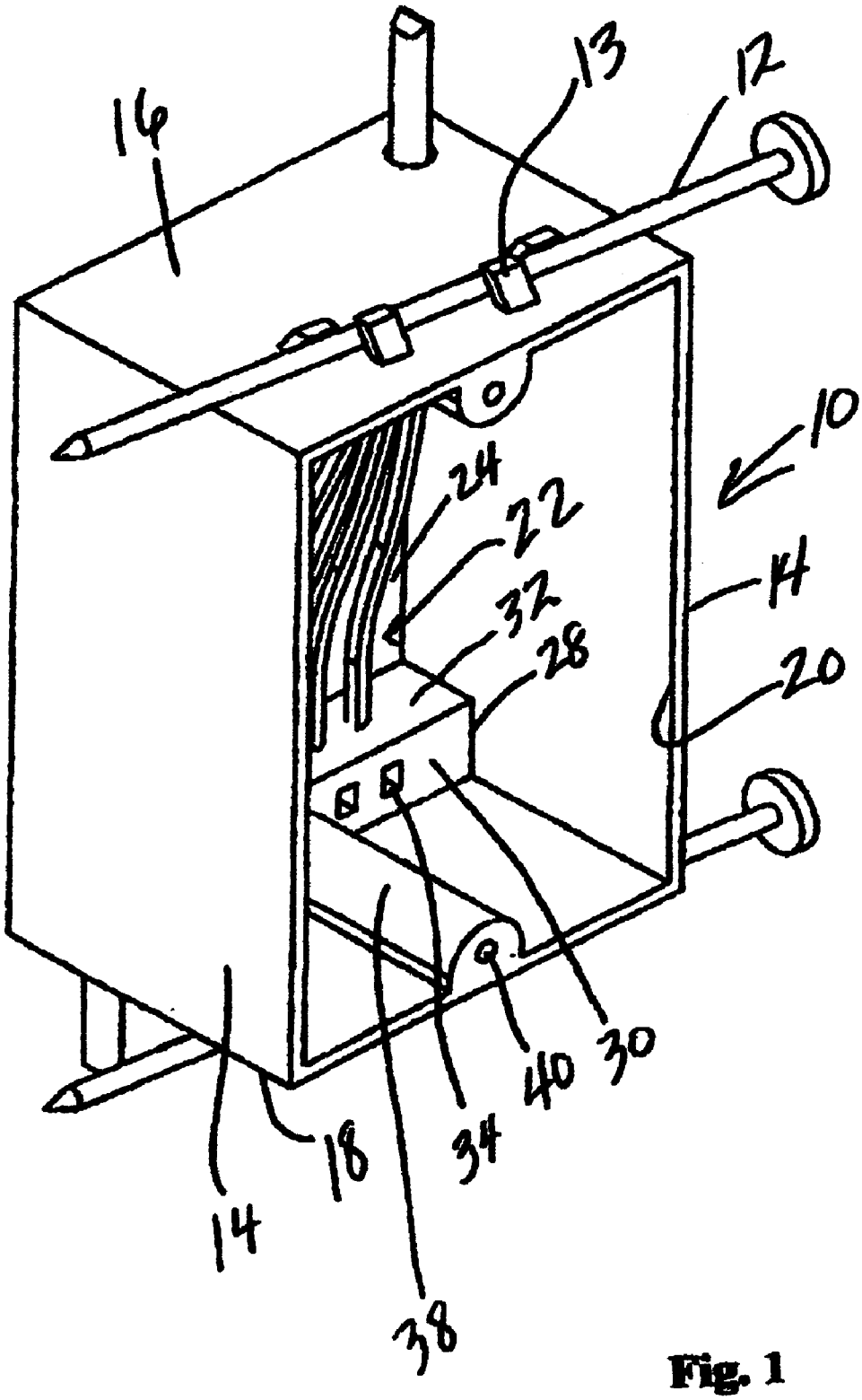
FIG. 1 is a perspective view of a first electrical modular unit for the modular plug-in electrical wiring system of this invention.

The present invention is directed to a modular plug-in electrical wiring system that includes a first or universal electrical modular unit for selective placement in a wall recess, and a second electrical modular unit for mating therewith. The system hereof is designed for ease of installation for any typical electrical components, such as receptacles, switches, and lighting fixtures. Different components, which by way of example may be receptacles and switches, when inserted or mated into the first modular unit, would automatically make necessary connections to electrical connectors that are built into the first modular unit at the time of manufacture. Likewise, light fixtures, ceiling fans, and smoke detectors, when installed, would also make the necessary connections to electrical connectors built into the ceiling box, for example, at the time of manufacture. This system, as will be apparent in the description which follows, will eliminate electrical boxes that are overstuffed with a tangled mess of wires and wire nuts. The manner by which this is accomplished will become clearer in the following specification and drawings, where like reference numerals represent like components or features throughout the several views.

Figure 2:
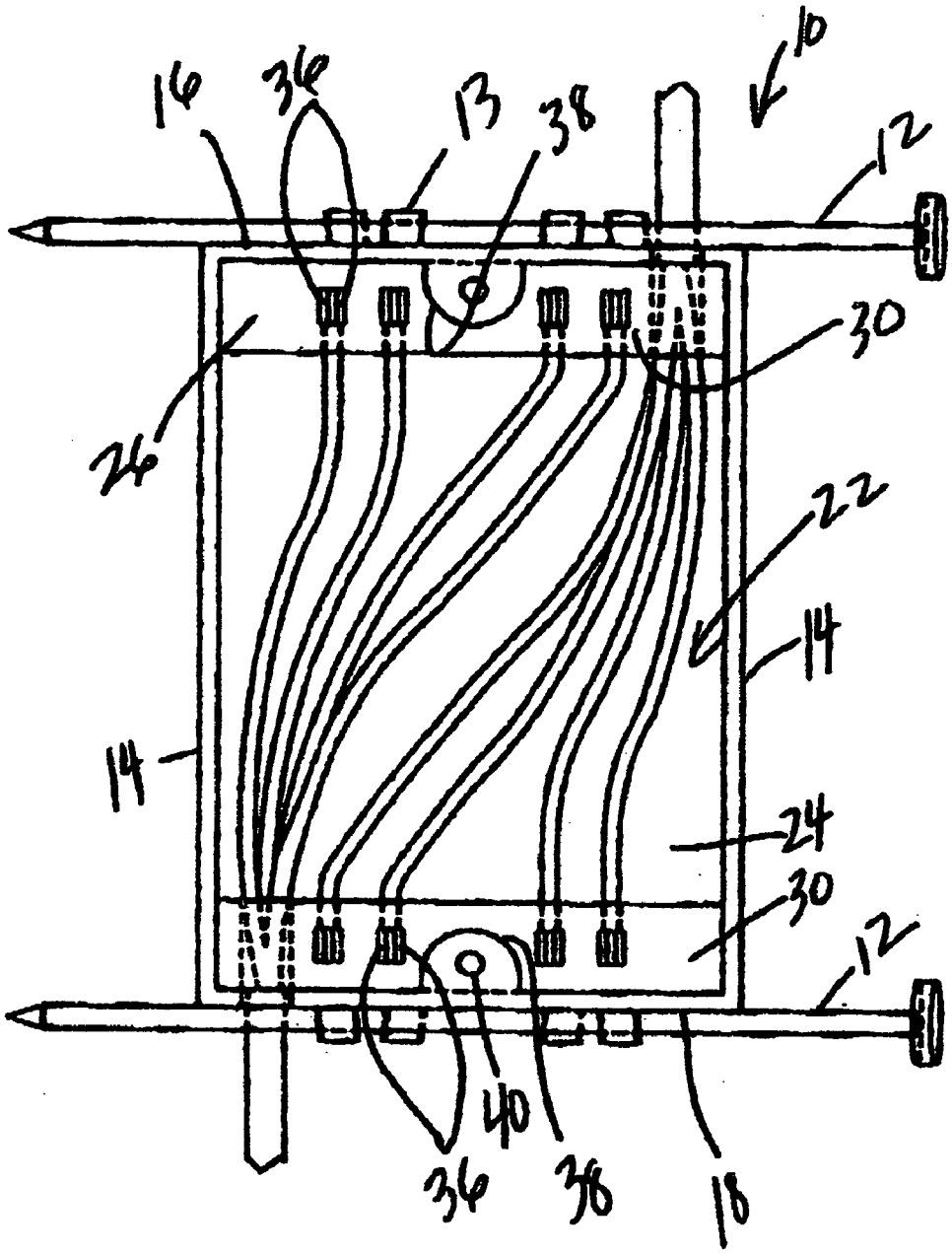
FIG. 2 is a front view of the first electrical modular unit illustrated in FIG. 1.

Turning first to FIGS. 1 and 2, illustrating the first or universal electrical modular unit 10, the first unit 10 is adapted to be mounted within a wall recess (not shown), and secured therewithin by a pair of angled nails 12 or spikes to a wall 2×4, slidably secured within a pair of opposing arms 13, a conventional securement means as known in the art. The first unit 10 comprises a pair of side walls 14, a top wall 16 and a bottom wall 18, where said walls define an open front face 20 for receiving the second modular unit, as later discussed with regard to FIGS. 3 and 4. The rear is closed off by a rear wall 22, where the inner surface 24 thereof includes upper and lower, forwardly extending shoulders 26, 28, respectively. The respective shoulders are defined by forward faces 30 and lateral faces 32. As best seen in the wired configuration of FIG. 2, it will be observed that external multi-cabled conductors enter the top wall 16 and bottom wall 18, where the plural conductors are separated and inserted into appropriate openings in the respective lateral faces. It is further observed that no exposed conductors are visible and exposed within the first unit 10.

Though the preferred use of the system hereof is a modular system for walls, especially for receptacles or switches, the system may be used as a ceiling box that is capable of receiving lighting fixtures, ceiling fans or smoke detectors with no adaptations necessary.

The plural single conductors, which are spaced apart and inserted into the respective shoulders 26, 28, are in electrical communication with a like number of spaced apart openings 34 in the forward faces 30. That is, electrical conductors may be fed into the respective shoulders in the same manner as is currently practiced with traditional connectors. Once inside the housing, the conductors are stripped and inserted into color coded 'push-in' terminals making the connections. Further, there may be two sets of 'push-in' terminals at both the top shoulder and bottom shoulder to facilitate an extra electrical conductor to 'feed' additional components or appliances where needed in multi-gang boxes. The several openings 34 may include a pair of opposing spring metal arms 36 to ensure electrical contact with metal aims inserted therewithin, as later discussed with FIGS. 3 and 4.

Figure 3:
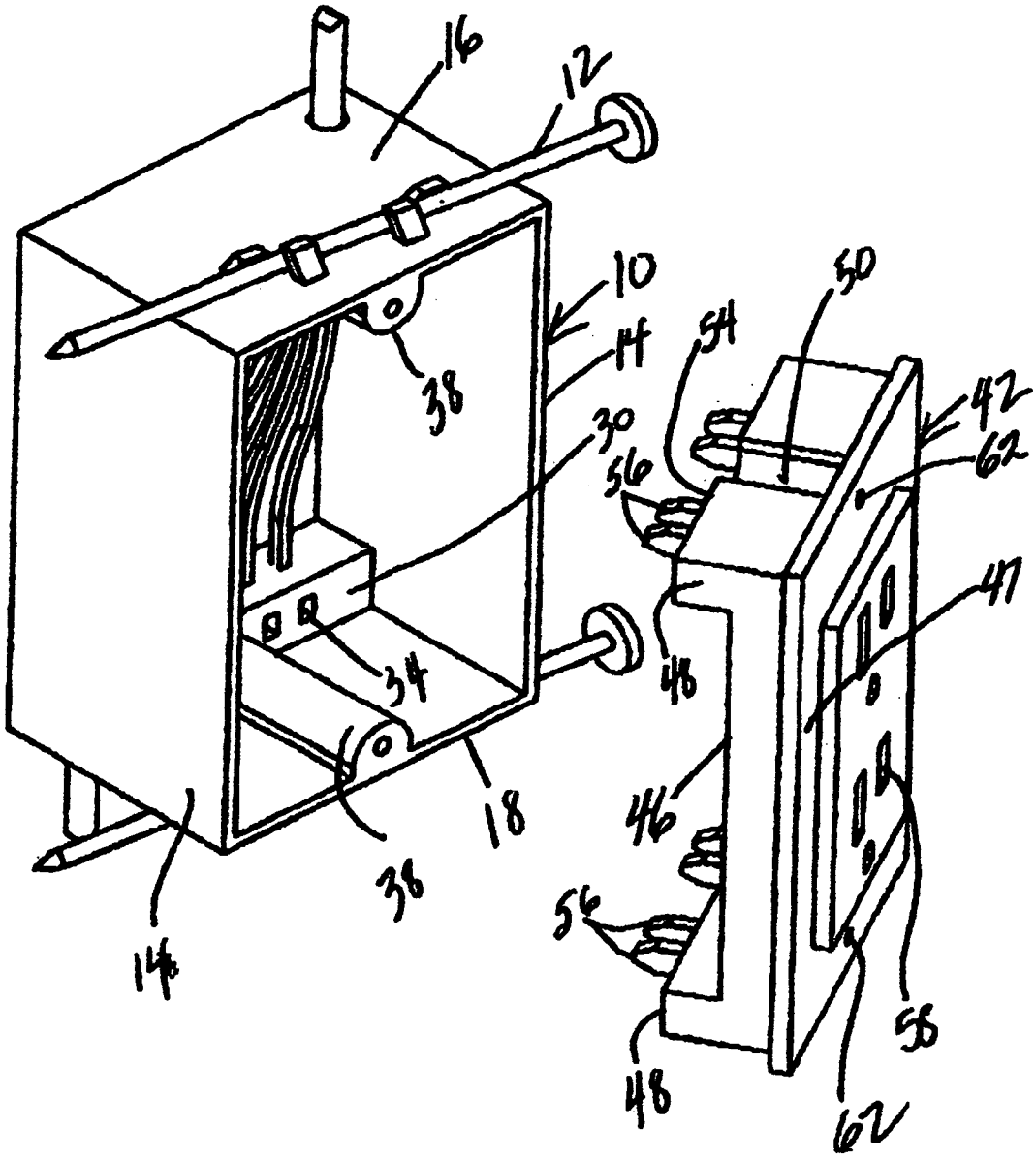
FIG. 3 is an exploded perspective view showing the first electrical modular unit of FIGS. 1 and 2, and a second electrical modular unit, in the form of an electrical outlet, poised for electrical mating with said first electrical modular unit.
Figure 4:
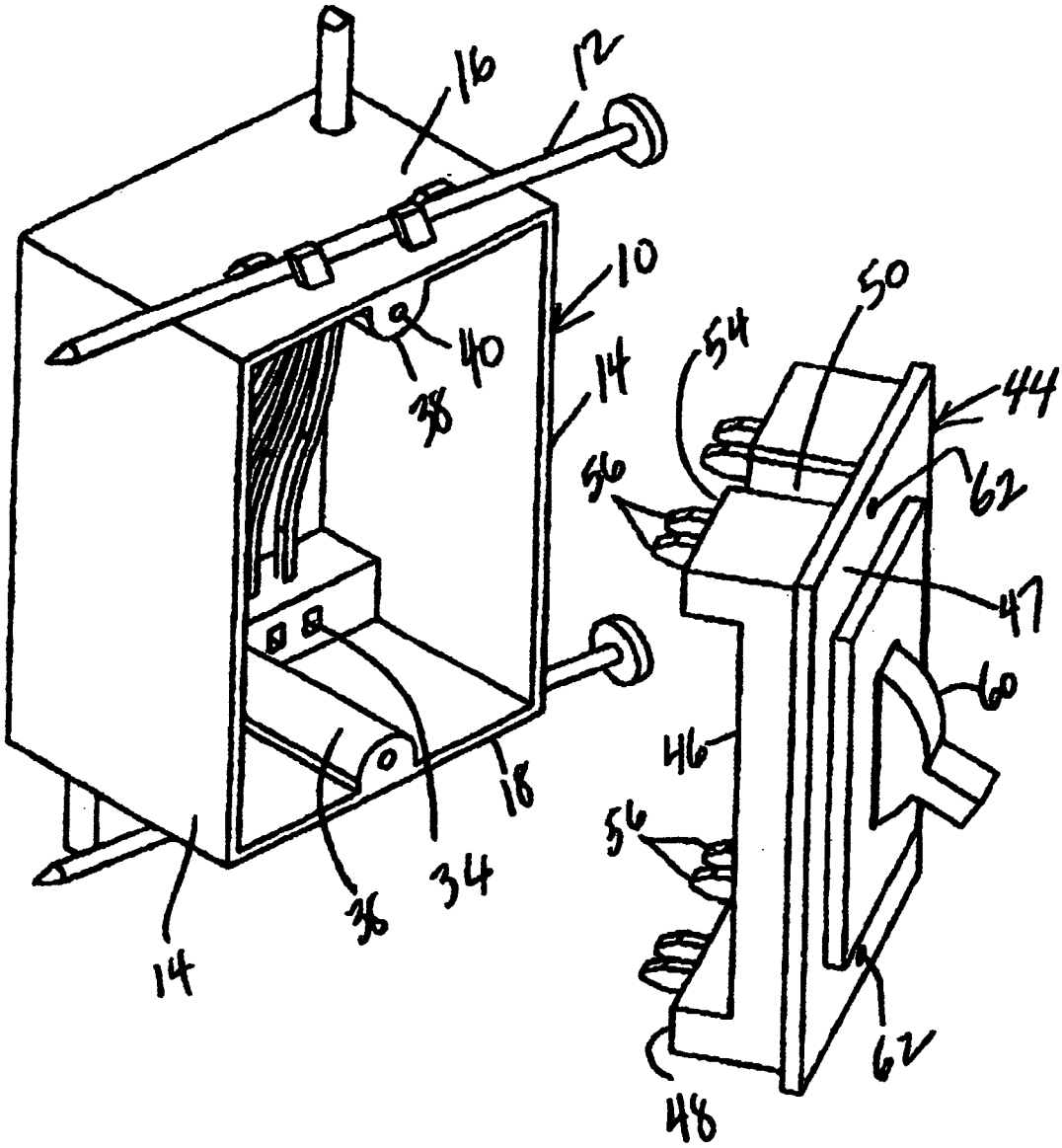
FIG. 4 is an exploded perspective view similar to FIG. 3, showing a second electrical modular unit, in the form of a switch, poised for electrical mating with said first electrical modular unit.

Finally, the first modular unit 10 may include a pair of forward extending ribs 38 which are provided with threaded apertures 40 for threadably receiving a fastener to removably secure the second modular unit thereto, see FIGS. 3 and 4.

FIGS. 3 and 4 illustrate the pair of matable, modular plug-in electrical units, where FIG. 3 shows the second modular plug-in unit 42 as a conventional outlet, and FIG. 4 shows the second modular plug-in unit 44 as a switch. It is apparent that the switch may actually be a pair of switches to separately control a ceiling fan and ceiling light. In any case, each said second unit 42, 44 comprises an essentially U-shaped housing body 46, sized for sliding receipt within said first modular plug-in unit 10, extending rearwardly from a face plate 47, having a pair of spaced apart, parallel free legs 48, with a central recess 50 for receiving the forward ends 52 of the forward extending ribs 38. The respective free legs 48 include a rearward oriented face 54 that includes plural electrical metal arms 56, where a given said metal arm is aligned with a selected said spaced apart opening 34. Within the housing body 46 the respective metal arms are wired, by means known in the art, to be in electrical communication with the outlet slots 58 (FIG. 3), or with the ON/OFF switch 60 (FIG. 4). That is, with the first and second matable, modular units 10 and 42, 44, suitably mated, electrical connection to the outlets slots 58 or activation of the ON/OFF switch 60 will energize the desired appliance. Though only a receptacle and switch are illustrated, the system hereof has the capability or receiving any type of device whether it be a 2-way, 3-way, 4-way switch or dimmer, receptacles or GFCI receptacles, without any adaptations to the system.

Finally, to removably secure the matable modular units together, the face plate 47, in proximity to the edge and aligned with the central recess 50, fastener openings 62 are provided. By this arrangement, a pair of threaded fasteners (not shown) may be inserted through the openings 62 and threaded into respective aligned threaded apertures 40.

Figure 5:
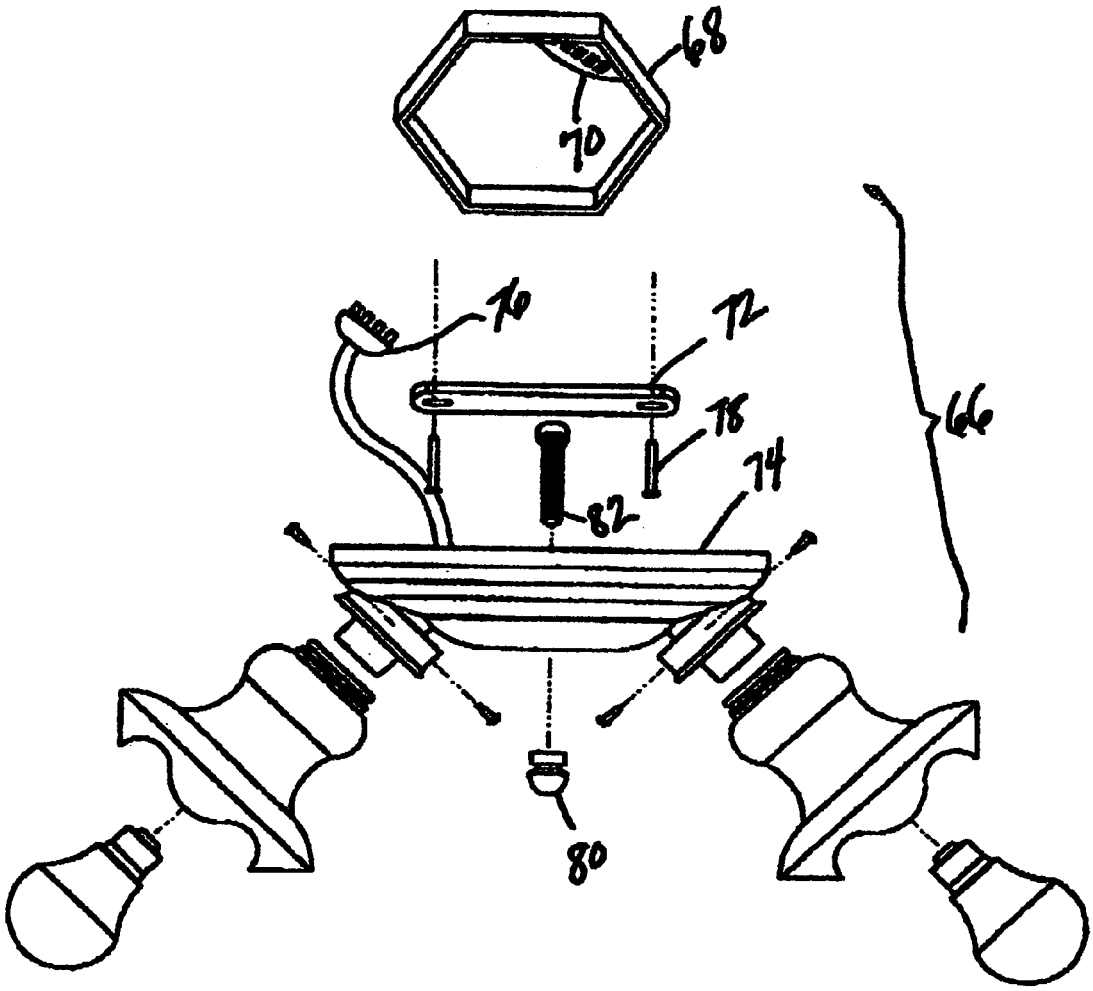
FIG. 5 is a plan/perspective view showing the versatile application of the electrical modular unit system of this invention for a ceiling light according to this invention.
Figure 6:
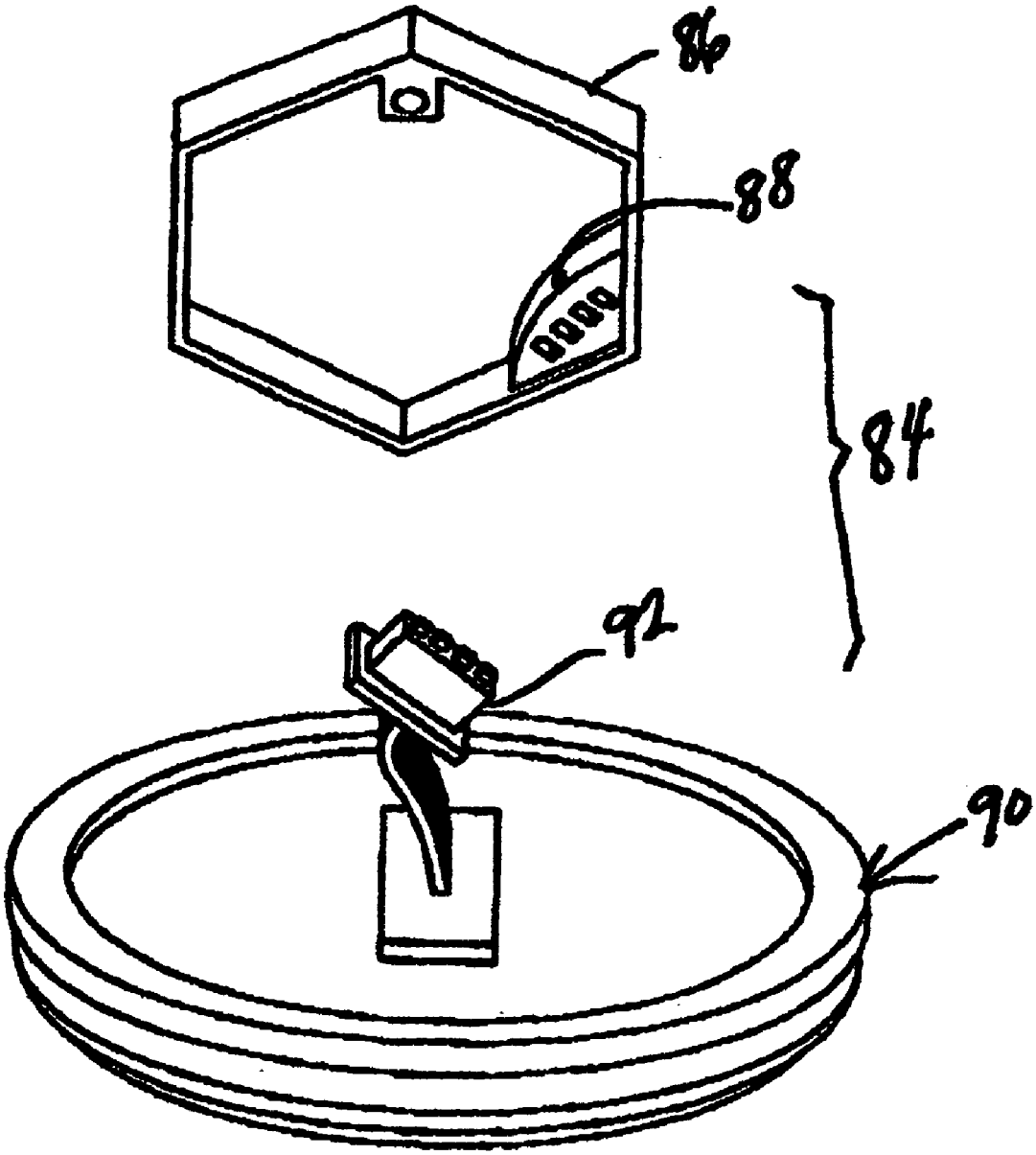
FIG. 6 is a plan/perspective view showing the use of the electrical modular unit system for securing a wired smoke alarm, or related device.

FIGS. 5 and 6 help illustrate the versatility of the electrical modular unit system of this invention. FIG. 5 is an exploded view of a ceiling light assembly 66 that includes an outlet box 68 containing a modular electrical unit 70 comparable to said first modular unit 10 described above. The ceiling light assembly includes a mounting bar 72 to which the light fixtures and light canopy 74 are suspended. Within the light canopy 74, as known in the art, electrical wiring is provided, where the wiring includes a hard wired second modular unit 76 for engagement with the modular electrical unit 70. To secure the ceiling light assembly to the mounting bar 72, which in turn has been secured by screws 78 to the outlet box 68, a fastener nut 80 threadably engages the threaded rod 82 of the mounting bar 72.

FIG. 6, further showing the broad application for the system hereof, illustrates a smoke alarm assembly 84, or related device, where the smoke alarm assembly 84, is typically mounted on a wall, not shown. The smoke alarm assembly 84 includes a mounted outlet box 86 within which is a first plug-in, electrical modular unit 88, similar to the first modular unit 10 described above. For engagement with the first modular unit 88, the smoke alarm 90, or related device, includes a second, electrical modular unit 92 to which the smoke alarm 90 is electrically wired, as known in the art. By this simple arrangement, the mounting is accomplished free of entangled wires as typically found with conventional wall and ceiling devices.

It is recognized that changes, variations and modifications may be made to the modular plug-in electrical wiring system and components thereof, particularly by those skilled in the art, without departing from the spirit and scope thereof. Accordingly, no limitation is intended to be imposed on the invention except as set forth in the accompanying claims.

What is claimed is:

1. A modular plug-in electrical wiring system for selective placement in a recess of a wall, said system comprising:

a.) a first electrical modular unit consisting of a housing formed by a pair of side walls, a bottom wall, a top wall, where said walls combine to define an open face, and a rear wall, said rear wall characterized by a pair of spaced apart shoulder members having access means for receiving plural connectors along a first surface, and plural electrical access openings in electrical communication with said plural connectors along a second surface, and external means for securing said housing within said wall recess; and, b.) a second electrical modular unit removably matable with said first electrical modular unit, said second modular unit comprising a face plate with a U-shaped housing extending rearwardly therefrom, said U-shaped housing featuring a pair of legs having plural metal arms extending from said legs for electrical engagement with said electrical access openings, and means on said face plate for electrically activating said mated modular units.

2. The modular plug-in electrical wiring system according to claim 1, including means to removably secure said second modular unit to said first modular unit.

3. The modular plug-in electrical wiring system according to claim 1, wherein said U-shaped housing is sized for sliding engagement within said housing of said first modular unit.

4. The modular plug-in electrical wiring system according to claim 1, including openings on said top and bottom walls for receiving external conductors for engagement within said first modular unit.

5. The modular plug-in electrical wiring system according to claim 1, wherein said means on said face plate is at least one ON/OFF switch.

6. The modular plug-in electrical wing system according to claim 1, wherein said means on said face plate is a plug-in receptacle for receiving an electrical connection to an appliance.

7. The modular plug-in electrical wiring system according to claim 2, wherein means to removably secure said units together comprises a pair of rearwardly directed ribs on said top and bottom walls, each containing a threaded slot, and a pair of aligned apertures on said face plate for receiving complementary threaded fasteners for threaded engagement with said threaded slots.

* * * * *